United States Patent [19]

Ellman et al.

[11] 4,078,794

[45] Mar. 14, 1978

[54] ROTATABLE BAR GAME

[76] Inventors: Julius Ellman, 1672 E. 7th St., Brooklyn, N.Y. 11230; George Lerner, 12 Prospect Ct., Freeport, N.Y. 11520

[21] Appl. No.: 616,688

[22] Filed: Sep. 25, 1975

[51] Int. Cl.[2] ..... A63B 71/00

[52] U.S. Cl. ..... 273/1 R

[58] Field of Search ..... 273/95 A, 95 R, 97 R, 273/98, 101, 1 R, 141 AU, 142 AU; 272/31

[56] References Cited

U.S. PATENT DOCUMENTS

| | | | |
|---|---|---|---|
| 719,448 | 2/1903 | Farnum | 273/141 R |
| 1,527,532 | 2/1925 | Alcaraz | 273/97 A |
| 2,523,911 | 9/1950 | McKay | 273/142 R |
| 3,047,295 | 7/1962 | Sachs | 272/31 R |
| 3,161,409 | 12/1964 | Nutting | 273/97 R |
| 3,606,324 | 9/1971 | Welbourn et al. | 273/1 R |
| 3,649,009 | 3/1972 | Breslow | 273/1 R |
| 3,724,855 | 4/1973 | Chu | 273/101 |
| 3,743,285 | 7/1973 | Walker | 273/1 R |
| 3,904,203 | 9/1975 | Matsumoto | 273/85 R |
| 3,936,050 | 2/1976 | Hornsby | 273/95 A |

*Primary Examiner*—Richard C. Pinkham
*Assistant Examiner*—Arthur S. Rose
*Attorney, Agent, or Firm*—Paul J. Sutton

[57] ABSTRACT

This invention relates to games, and more specifically to games for stopping a moving ball. This game has at least two player stations, the player stations may be suitably joined together to form a base portion. The base portion has a central stand element supported thereon, the stand being used to rotatably mount a bar or spinner arm. The bar has a ball secured to one end thereof and has a downwardly extending pin structurally associated therewith in close juxtaposition to the ball. Each player station has a pivotally mounted lever having apertures in one end thereof. The game is played by one player serving and each player may thereafter hit or trap the ball by causing the downwardly extending pin to be captured in one of the apertures and thus stopping the ball from further rotation.

8 Claims, 8 Drawing Figures

ROTATABLE BAR GAME

BACKGROUND OF THE INVENTION

Games which incorporate striking an object, such as a ball, or stopping or catching an object, such as a ball, are well-known in the art. For example, tether-ball is a well-known and popular game. In this game a ball is attached to a string and the string is secured to an upright rigid immovable post. The object of this game is to hit the ball back and forth using paddles, bats, hands or any other conventional type of racket or other striking object. Several United States patents disclose games similar or identical to tether-ball including U.S. Pat. Nos. 786,997; 1,708,796; 3,809,406; 3,764,140; 3,729,195; 3,521,885 and 3,455,552.

It is also known in certain games to position a ball on the lower end of a lever. The ball is attached to a support by means of a string or rod. The top portion of the lever is forced down, thus moving the lower end up and propelling the ball into the air. The ball is then struck by a suitable object, such as a bat or paddle. The length of the string limits the ball's travel and also prevents the ball from being lost. Several patents, including U.S. Pat. Nos. 3,243,620 and 3,161,409, disclose this type of game device.

There are also games which consist of attempting to catch on a rod a ball having a plurality of apertures on the surface thereof. U.S. Pat. No. 609,390 discloses such a game. U.S. Pat. Nos. 1,252,957 and 2,211,330 disclose similar games, wherein a rolling apertured ball is stopped by a spear or rod.

The prior art has either games which consist of striking a ball or games which stop or catch a ball, but does not disclose a game which employs both game features.

SUMMARY OF THE INVENTION

It is, therefore, an object of this invention to provide a game which includes both the striking and catching of a ball.

It is also an object of this invention to provide a game which is easily transportable.

Another object of this invention is to provide a game which can be played anywhere, as well as in a confined area, such as in a livingroom of a house.

These and other objects are achieved, for example, by joining two player stations together by means of a cone-shaped connector. Each player station has an upright housing joining a "U-shaped" groove or channel. A lever arm is pivotably mounted in the groove of each housing by pin means. The outside end of the arm is flat so that it may be struck by a player and the other end has three recess means or holes. The cone portion has flanges on its base which cooperate with grooves on the two player stations, so that the three pieces can be locked together as an assembly. A horizontal bar or spinner arm with a downwardly directed pivot pin is rotatively positioned on the cone. This bar rotates freely about its pivot axis on the cone. A ball and its associated downwardly directed pin is secured to one end of the bar. The ball of the bar is struck in order to rotate the bar. The outside ends of the lever arms are now struck down so that the recess means or holes in the lever arm can be used to catch the pin of the ball and thus stop the ball's movement.

The invention accordingly consists in the features of construction, combinations of elements, and arrangements of parts, which will be exemplified in the construction hereinafter described, and of which the scope will be indicated by the appended claims.

DETAILED DESCRIPTION OF THE INVENTION

Figures 1, 8:
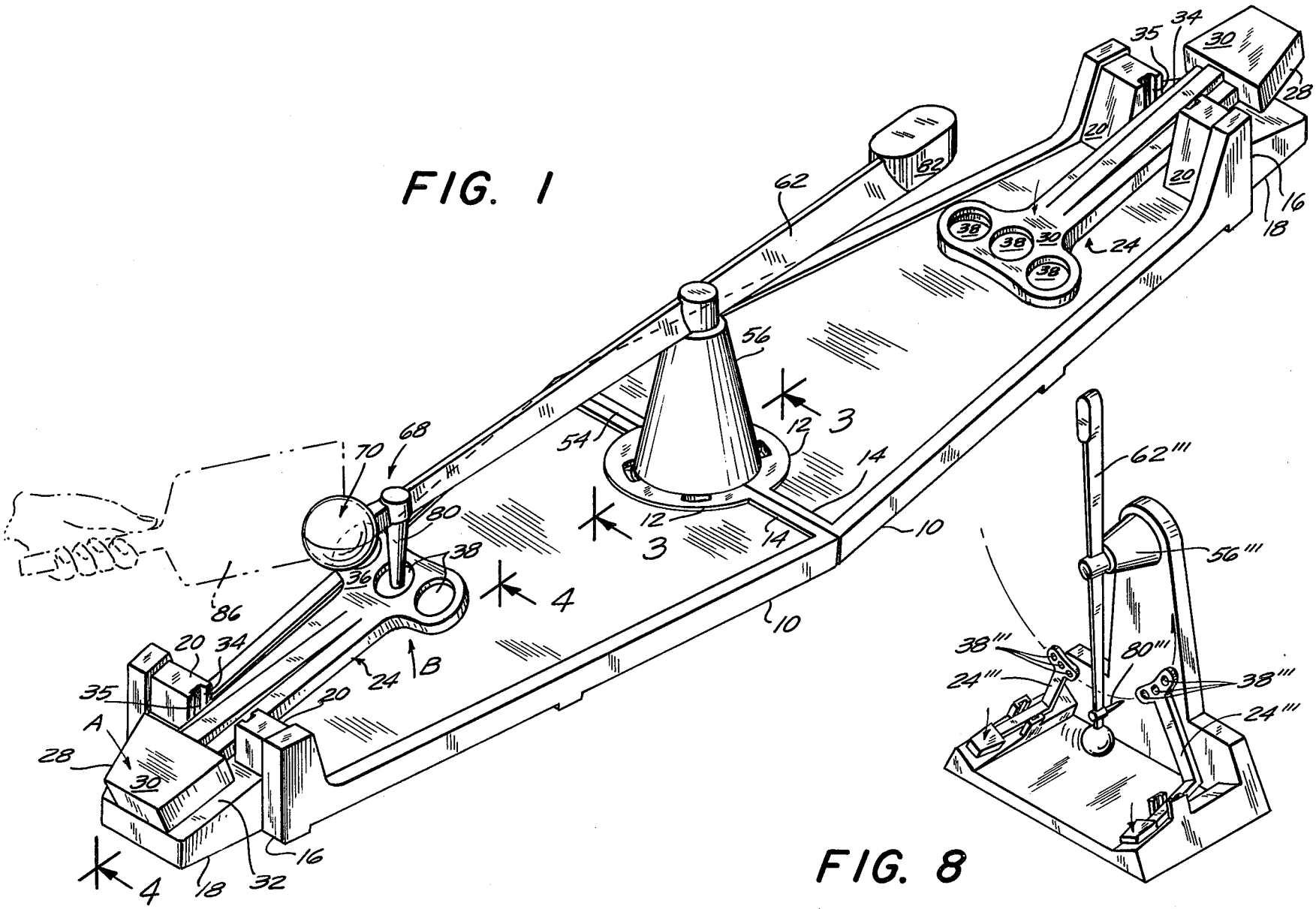
FIG. 1 is a perspective view of the preferred embodiment of the game device of the invention.
FIG. 8 is a perspective view of an embodiment, wherein the pivot bar rotates in a vertical plane.

Referring now to FIG. 1, the game device is provided with two matching player stations 10. The stations 10 are put together in such a way as to define a central base area 12. In this particular embodiment or modification of the instant invention, a portion of the central base area 12 is made integral with each of the player stations 10.

It is within the scope of this invention to form the player stations separate from the central base area. In such an instance, the player stations and the central base may or may not be mounted on a common board, which helps to keep constant the spacing therebetween. When the central base area is not formed as a part of each player station, the players must be certain that the player stations are all equidistant from the central base area and generally immovable from such positions. The player stations must also not be placed so far away from the central base that the pivot bar 62 (described hereinafter) cannot pass over them.

Each player station 10 is essentially trapezoidal in shape and is tapered, so that it is wider at the inner end 14 than at the outer end 16. The player stations 10 may also be triangular or any other suitable shape. There are many materials of construction which may be used to fabricate the player stations and the central base area, such as plastic, metal or wood.

Two upright facing supports 20 are suitably integrally formed with the player station 10 at the outer end 16 thereof to define an upright channel 34 therebetween. The sides of the supports 20 facing each other may be provided with grooves 35. Each of the said facing sides of the supports 20 is provided with a recess or an aperture 22, each of said recesses or apertures 22 being in the same horizontal plane.

A lever arm 24 is provided, which is pivotably mounted in said upright channel 34. Aligned pins 26 are provided on the lever arm 24, and said pins 26 are symmetrically located on each side of said lever arm 24. This arrangement provides a pivotal mounting for said lever arm 24. It will be appreciated that the above arrangement can work equally as well without the grooves on the facing sides of the supports 20.

The lever arm 24 is provided at its front end 36 with at least one recess means, such as a "blind" hole, or aperture 38, in this case three circular apertures. When more than one aperture is provided, the apertures are placed in a plane perpendicular to the plane of the lever arm. At its other end the lever arm is provided with a striking portion 28. This striking portion 28 may have any suitable shape, but in the embodiment illustrated, it has an essentially trapezoidal face portion 30 which may be integrally formed with the lever arm 24.

A limit stop 18 is integrally formed with the player station 10 at the outer end 16 thereof. This limit stop 18 may be in the form of a wedge, as is best shown in FIG. 1.

When the striking portion 28 is forced down, as shown by the arrow A in FIG. 1, the front end 36 is forced upward, as shown by the arrow B in FIG. 1. The limit stop 18 serves to effectively limit the downward movement of the striking portion 28 and, thus, limits the upward movement of the front end 36. This is preferably done, so that the apertures 38 do not travel so far up the downwardly extending pin 80 so as to cause the front end 36 to strike the under surface of the rotating spinner arm or bar 62 and possibly cause damage thereto.

Figure 2:
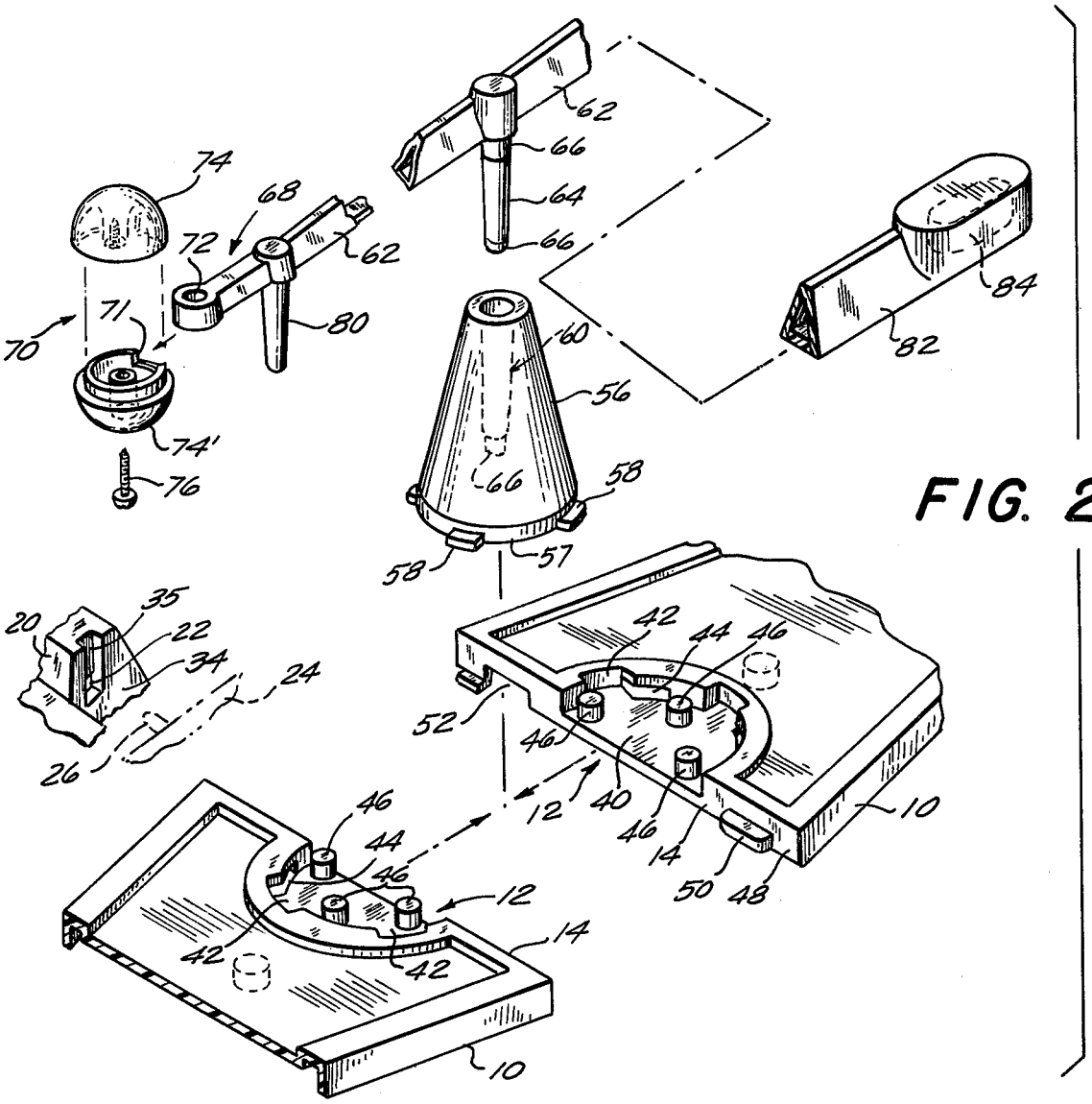
FIG. 2 is an exploded view showing the construction and assembly of the base area, cone portion, bar or spinner arm portion and the pivot portion.

As hereinbefore described, with respect to the embodiment of FIG. 1, each player station 10 is made integrally with a portion of the central base area 12. The central base area 12 may be of any desired shape and size and in the preferred embodiment is circular in shape. The central base area 12 of the preferred embodiment has a plurality of slots 42 and grooves 44 defined in a depressed or recessed central portion 40 of the base 12. The depressed or recessed portion 40 may, if desired, be provided with a plurality of studs 46 for quickly aiding in aligning the cone 56 (hereinafter described). When each player station 10 has a portion of the base area 12 thereon, the portions are in the form of semicircles, as shown in FIG. 2.

When the player stations 10 are to be interconnected, they each have a set of mating flanges 50 and slots 52 on the front faces 48 thereof. In joining the stations 12 together, the flanges 50 and slots 52 interengage to form a flush joint where the front faces meet, as at 54 in FIG. 1.

A support is generally used for supporting the spinner or rotating arm 62. The support can be of any size and shape, and should have a base portion, whose shape is compatible with the shape of the base 12. For instance, if the base 12 is circular, the support should have a circular base. In the instant case, the support is a cone 56 with a circular base 57. Flanges 58 extend out from the base and interengage with the slots 42 and grooves 44 of the base 12.

The base 57 of the cone 56 is placed in the recessed or depressed portion 40 with the flanges 58 resting in the slots 42. The cone is partially rotated so that the flanges 58 engage the grooves 44. In this position the cone 56 cannot be lifted out of the depressed portion 40 of the base 12; and the player stations 10, the base 12 and the cone 56 are effectively locked together. To unlock these elements, the cone 56 is rotated in the opposite direction from which it was originally rotated and is then lifted out of the recessed or depressed portion 40.

The base 12 may be any other type of configuration for bracing and holding and/or securing the support for a rotating arm. Alternatively, a support may be omitted and, instead, an extra long pivot pin 64 may be utilized. In this case the pin 64 must be sufficiently long so as to elevate the spinner or rotating arm 62 to a proper height. Of course, the pin 64 would be rotatably mounted in any suitable manner on the base 12. This would probably be the preferred mode for a game device wherein the player stations 10 and the base 12 are not integrally formed together.

Figure 3:
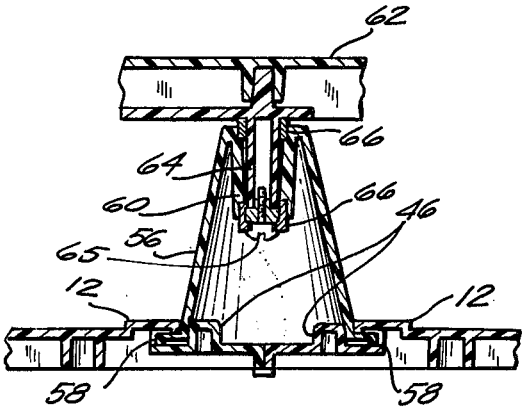
FIG. 3 is a cross-sectional view taken along the line 3—3 of FIG. 1.

The cone 56, or other suitable support, is suitably provided with a sleeve element 60 at the top thereof. This sleeve 60 is used to rotatably mount the spinner arm or pivot bar 62 on the cone 56. The pivot bar 62 is provided with a downwardly extending pivot pin 64, which is rotatively mounted in the sleeve 60. A screw 65, as best shown in FIG. 3, secures and connects together in a rotable fashion the bottom of the sleeve 60 of the cone 56 to the pin 64. Bearings 66 are provided in the bottom of the sleeve 60 and at both ends of the pin 64 in order to reduce the friction between these two rotatably oriented surfaces. Any suitable low friction material may be used for the bearings, such as Teflon. In this embodiment of the game device, the pivot bar 62 is free to rotate in a horizontal plane, as shown by the reference arrow C in FIG. 1.

It will be understood and appreciated that it is within the scope of the invention to provide the sleeve on the spinner arm and the pivot pin on the support structure. As will be explained in greater detail hereinafter with respect to FIG. 8, the pivot bar or spinner arm may be rotated in a vertical plane.

One end 82 of the spinner arm or bar 62 is counter balanced by means of a suitable weight, such as a lead weight 84, or other suitable weighted means embedded therein. Such balancing allows for a smoothly rotating arm or bar.

End 68 of the bar 62 is suitably provided with an aperture 72 therethrough. The ball 70 is suitably made of two halves 74 and 74'. The top half 74 has a stud 75 with a threaded hole therein which is passed downwardly through the aperture 72, so that the top ball half 74 rests on the end 68 of the bar 62. The bottom half 74' has another stud 75' with a through clearance hole provided therein. The bottom half 74' also has a larger concentric recessed hole 78 in the bottom portion of the stud, so that a suitable fastener, such as a screw 76, can be passed through the stud 75'. The bottom half 74' of the ball is held to the top half 74 and the screw 76 is inserted into hole 78 and threaded into the first stud 75. This effectively locks the two halves of the ball 70 around the end 68 of the bar 62. A notch in each half of the ball together define a cut-out 71 in the ball 70 to clear the bar 62 and to facilitate positioning the ball 70 about the end 68 of the bar 62.

A downwardly extending pin 80 is preferably integrally formed with the bar 62 at the end 68 in close proximity to the ball 70. This pin 80 is cooperatively associated with the recess means or the apertures 38 on the lever arm 24 and they coast together during play of the game in order to stop the rotating bar 62.

To play the game a player is positioned near or in close proximity to the outer end 16 of a player station 12 and one player is chosen to start the game. All players use a racket or paddle 86 or similar object to strike the ball 70 to start and to continually rotate the bar 62. Each player forces the striking portion 28 of his lever arm 24 down to move the front end 36 up, so as to attempt to engage the pin 80 in the recess means or any one of the apertures 62 on his player station 10. The first player to stop the rotating arm 62 wins that round. Each aperture may be given a certain value, for instance the outer apertures may be worth one point and the middle aperture may be worth two points. The game is continued until one of the players reaches a predetermined value, such as eleven. As the ball 70 passes before each player, the player may strike the ball with his racket to rotate the spinner arm in the same direction or opposite direction, or do nothing instead of attempting to catch the ball 70 as was previously described hereinabove. By letting the ball pass without action by a player, the ball is allowed to slow down somewhat in its rotation, thus enabling the said player to possibly "catch" the ball if his opponent misses the ball on his turn.

Figure 5:
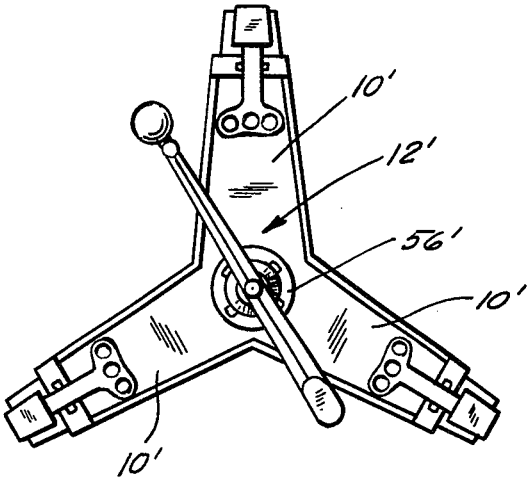
FIG. 5 is a top plan view of an embodiment of the invention, employing three player stations at 120° angles to each other.

In the modification of FIG. 5, the cone 56' is made integral with the base 12' and the stations 10'. FIG. 5 also shows the game set up with three player stations 10'.

Figure 6:
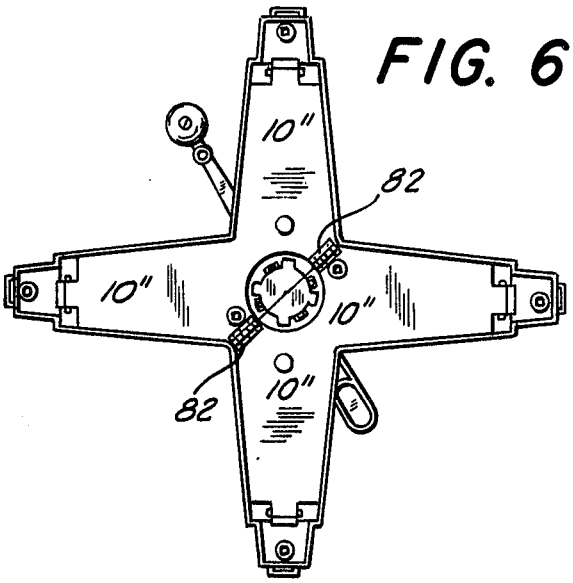
FIG. 6 is a bottom plan view of another embodiment of the invention, employing player stations at a 90° angle to each other.

FIG. 6 shows the game set up with four player stations 10''. In this figure, a piano hinge 82 is secured to the bottom surfaces of the player stations 10''. In this case the stations 10'' can be folded over each other, when the support or cone 56 is removed to form a compact package for shipping and storage.

Figure 7:
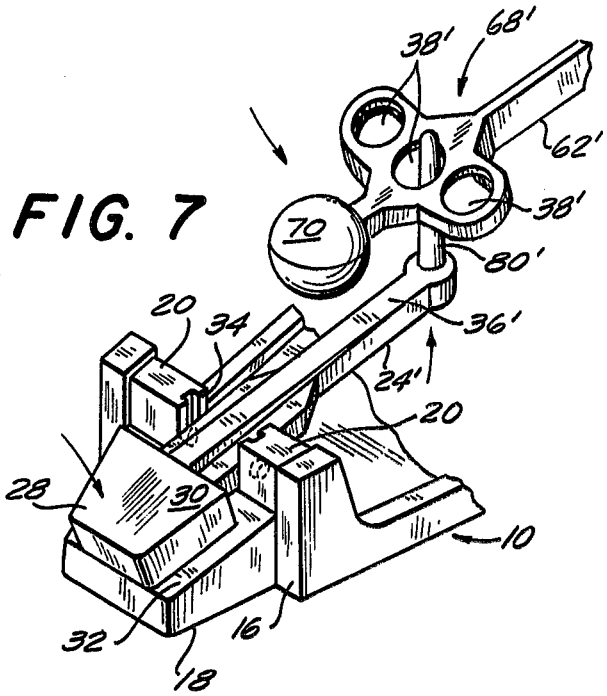
FIG. 7 is a partial perspective view of yet another embodiment, wherein the pin is on the lever arm and the recess means or apertures are on the pivot bar.
Figure 4:
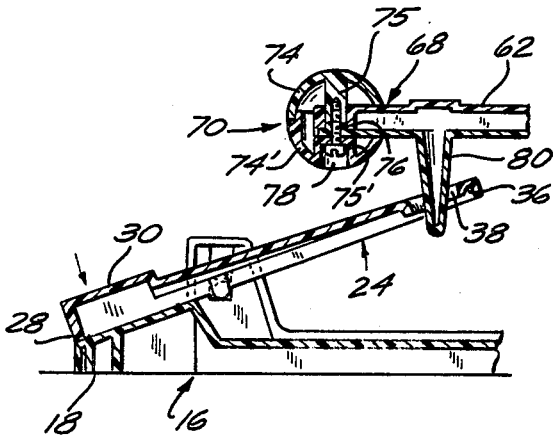
FIG. 4 is a cross-sectional view through a lever, taken along the line 4—4 of FIG. 1.

Referring now to FIG. 7, an alternate construction of the game is shown. In this embodiment, the pin 80' is upwardly extending from the front end 36' of the lever arm 24' and there are no apertures on the front end 36' of the lower arm 24'. Instead of a pin 80 on the bar 62, the bar 62 is provided at its end 68 with a plurality of apertures 38'. These apertures 38' are placed in the same plane, the said plane being perpendicular to the longitudinal and vertical planes of the bar 62.

In the embodiment of FIG. 8, the spinner 62''' is vertically oriented for rotation about a horizontal axis passing through the cone 56''' and the pin 80''' extends inwardly parallel to said axis. The player stations are provided with angled lever arms 24'''. These lever arms 24''' when actuated by a player pivot about suitable axes, thereby enabling the recess means or apertures 38'''.

While the invention has been described, disclosed, illustrated and shown in terms of an embodiment or modification which it has assumed in practice, the scope of the invention should not be deemed to be limited by the precise embodiment or modification herein described, disclosed, illustrated or shown, such other embodiments or modifications as may be suggested to those having the benefit of the teachings herein being intended to be reserved especially as they fall within the scope and breadth of the claims here appended.

I claim:

1. A game apparatus, comprising:

base means;

a bar rotatable substantially within a single plane;

at least one player station spaced from the center of rotation of the rotatable bar;

means for rotatably mounting said bar on said base means; and means carried by said player station and activated by the player for stopping the bar from rotating;

said means for stopping including a first portion supported by said bar and a second portion matingly cooperative with said first portion and supported by said player station, wherein said first portion and said second portion are disposed substantially equidistant from the center of rotation of the rotatable bar, said means for stopping including one of said bar and said player station including a male portion and the other including a female portion, said male and female portion being disposed substantially equidistant from the center of rotation of said bar, one of said male and female portions comprising a lever arm, means for pivotally mounting said lever arm to said player station, said female portion including at least one aperture formed therein, said lever arm including a striking portion at one end thereof, said player station including a limit stop, so that said striking portion of said lever arm will be stopped in the downward direction and thus limit the upward travel distance of the other end of the lever arm, said means for rotatably mounting including an upright support carried by said base means, said rotatable bar having a downwardly extending pivot pin rotatably mounted in an aperture at the top of said upright support, so that said rotatable bar can be rotated in said horizontal plane, said base means including a plurality of grooves and slots and the upright support including a mating set of flanges so that said upright support and said base means may be locked together.

2. The game apparatus according to claim 1, wherein the means for pivotably mounting comprises a pair of facing supports, mounted on said player station, defining a channel, each support having an aligned aperture through its facing side; and a pair of pins mounted on said lever arm and mounted in said apertures, so that said lever arm may pivot about an axis passing through said pins.

3. The game apparatus according to claim 1, wherein said upright support is cone-shaped.

4. The game apparatus according to claim 3, wherein hinge means connect the player stations together.

5. The game apparatus according to claim 3, wherein a portion of the base means is made integral with each player station.

6. The game apparatus according to claim 5, wherein each player station has a set of grooves and flanges, so that the player station may be aligned together.

7. The game apparatus according to claim 5, wherein the base means, the upright support and the player stations are made integral with each other.

8. The game apparatus according to claim 1, further comprising a ball mounted on said rotatable bar.

* * * * *